United States Patent [19]

Breen

[11] Patent Number: 5,056,161

[45] Date of Patent: Oct. 15, 1991

[54] HEADSET HAVING REDUCED WIDTH NESTED BANDS WHICH ARE GRASPED BY EARCUP SUPPORTING BLOCK

[75] Inventor: John J. Breen, Southboro, Mass.

[73] Assignee: Bose Corporation, Framingham, Mass.

[21] Appl. No.: 412,946

[22] Filed: Sep. 26, 1989

[51] Int. Cl.[5] ..... H04R 1/10

[52] U.S. Cl. ..... 2/209; 381/183

[58] Field of Search ..... 2/209; 381/183, 187; 379/430

[56] References Cited

U.S. PATENT DOCUMENTS

| | | | |
|---|---|---|---|
| 230,779 | 8/1880 | Hubbard | 381/183 |
| 1,714,377 | 5/1929 | Kiernan | 381/183 |
| 4,189,788 | 2/1980 | Schenke et al. | 381/183 X |
| 4,302,635 | 11/1981 | Jacobsen et al. | 381/183 X |
| 4,455,457 | 6/1984 | Akira | 381/187 X |

FOREIGN PATENT DOCUMENTS

| | | | |
|---|---|---|---|
| 0892298 | 3/1962 | United Kingdom | 381/183 |

*Primary Examiner*—Peter Nerbun

*Attorney, Agent, or Firm*—Fish & Richardson

[57] ABSTRACT

A low spring rate headset has at least one earcup with bands of approximately equal width nested together. An earcup is attached to at least one of the bands.

11 Claims, 2 Drawing Sheets

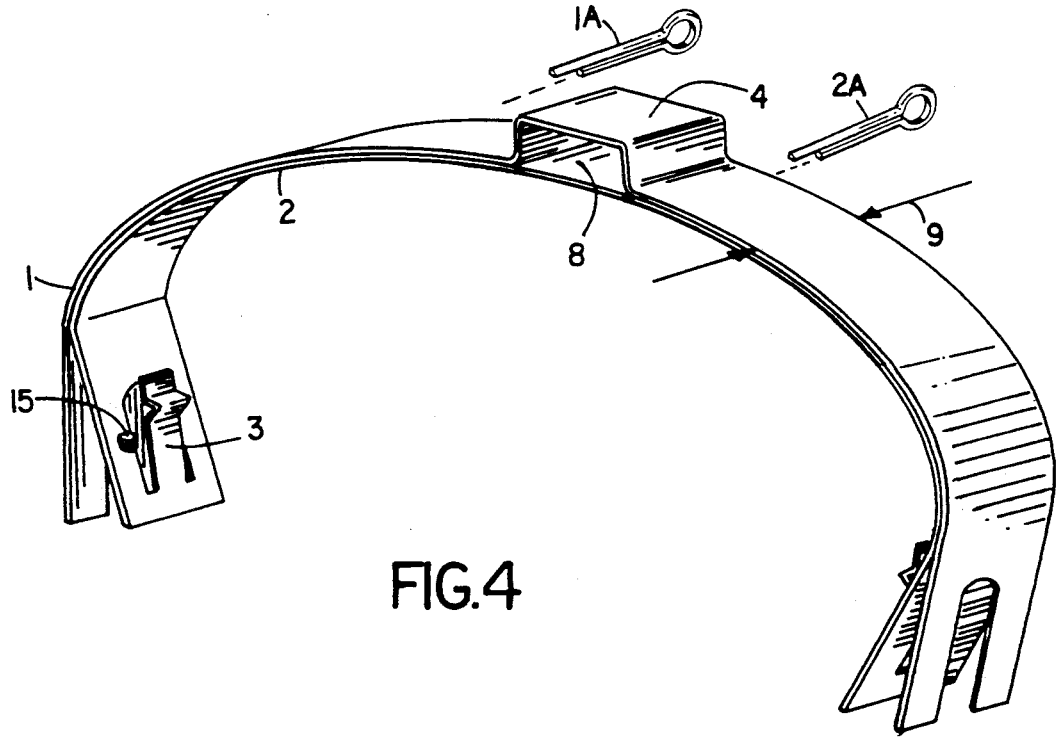
FIG.4
FIG. 5
PRIOR ART
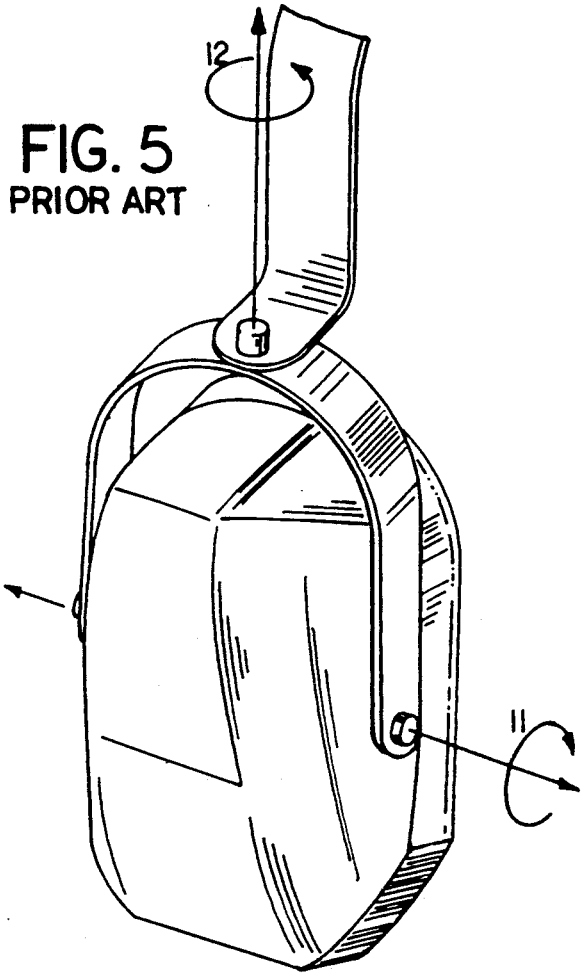
FIG. 6
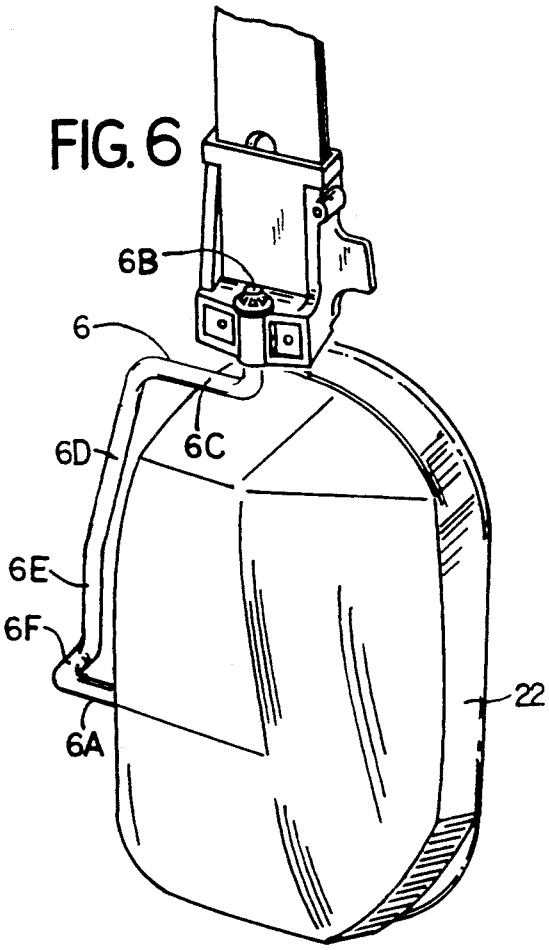

HEADSET HAVING REDUCED WIDTH NESTED BANDS WHICH ARE GRASPED BY EARCUP SUPPORTING BLOCK

FIELD OF THE INVENTION

This invention relates to low spring rate headsets and means to control the headset tension and maintain desirable styling qualities.

BACKGROUND OF THE INVENTION

Headsets commonly have a headband of spring material which passes over the head of the user and is attached to the earcups. The headband is used to provide tension on the earcups to hold them against the user's head with some predetermined force and also to provide vertical support to keep the earcups from falling under the influence of gravity. The tension supplied by the headband is in the form of a bending moment transmitted along the band. If the material, stress, and moment are fixed, the only variables which remain to finish the design are the width and thickness of the band. These are covered by the equation:

$$\text{Stress} = Mc/I \quad (1)$$

where M is the bending moment, c is one-half the material thickness, and I is the moment of inertia for the band cross section. For a rectangular cross section, the moment of inertia is given as:

$$I = b*h^3/12 \quad (2)$$

where b is the width of the material and h is the thickness. Manipulating these equations shows that:

$$Stress = 6*M/(b*h^2) \quad (3)$$

This last equation shows that to minimize the stress, the width b, and the thickness, h, must be made as large as practical. Since the thickness is squared in the above equation, changing the thickness will have a greater effect on the amount of stress than changing the width. The thickness and/or width must be maintained at certain levels to minimize the stress. The thickness also affects the rest radius.

Decreasing the thickness reduces the rest radius. The smaller the rest radius, the greater the distance the ends of the band must be moved before the use radius is reached. For a given use radius a smaller rest radius is desirable because a lower spring rate can be obtained. The thickness, h, however cannot be changed significantly without either affecting the rest radius or stress adversely. Decreasing the thickness to obtain a smaller rest radius will increase the stress level.

A typical prior art approach obtains a smaller rest radius and a desirable stress level by decreasing the thickness and increasing the width, b. The width that the typical prior art approach would like to use is often so large that it is beyond practical and styling limits.

OBJECTS OF THE INVENTION

An object of this invention is to provide a headset that supplies a known tension at the separation which represents the average user's head width.

Another object of this invention is to reduce the spring rate of the headband so that the variation in tension between users of different head widths can be as small as practical.

Another object of this invention is to provide a headband that moves the earcups together with some force in the unused state to protect the elements in the earcup.

Another object of this invention is to reduce the overall width of the headset for more desirable styling.

SUMMARY OF THE INVENTION

According to the invention, one headset includes at least two resilient bands of approximately equal width and length, means to nest the bands together, means to grasp said bands, and means to attach at least one earcup to at least one end of said bands. The headset supplies a known tension at the separation which represents an average user's head width and reduces the variation in tension between users of different head widths. When the headset is not in use, the earcups come together to protect the elements inside the earcup. This invention achieves the desired amount of tension in a headset with a relatively narrow stylistically attractive headband.

The invention achieves a narrower overall headband width and still maintains the desired amount of tension by breaking the width into two or more preferably equal-width bands which are nested into each other. The bands are grasped at each end so that they are working in a bending moment rather than as a cantilevered spring. The multiple nested narrow headbands behave the same as one wide headband of the same total width.

The foregoing and other objects, features, and advantages of the invention will be apparent from the following more detailed description with reference to the accompanying drawings in which like reference characters refer to the same parts throughout the different views. The drawings are not necessarily to scale, emphasis instead being placed upon illustrating the principles of the invention.

FIG. 4 is a perspective view of part of the headbands embodying certain principles of this invention, including the rectangular bend on the first band;

FIG. 5 is a pictorial view of a conventional yoke; and

FIG. 6 is a pictorial view of a preferred yoke according to the invention.

DETAILED DESCRIPTION OF THE INVENTION

Figure 1:
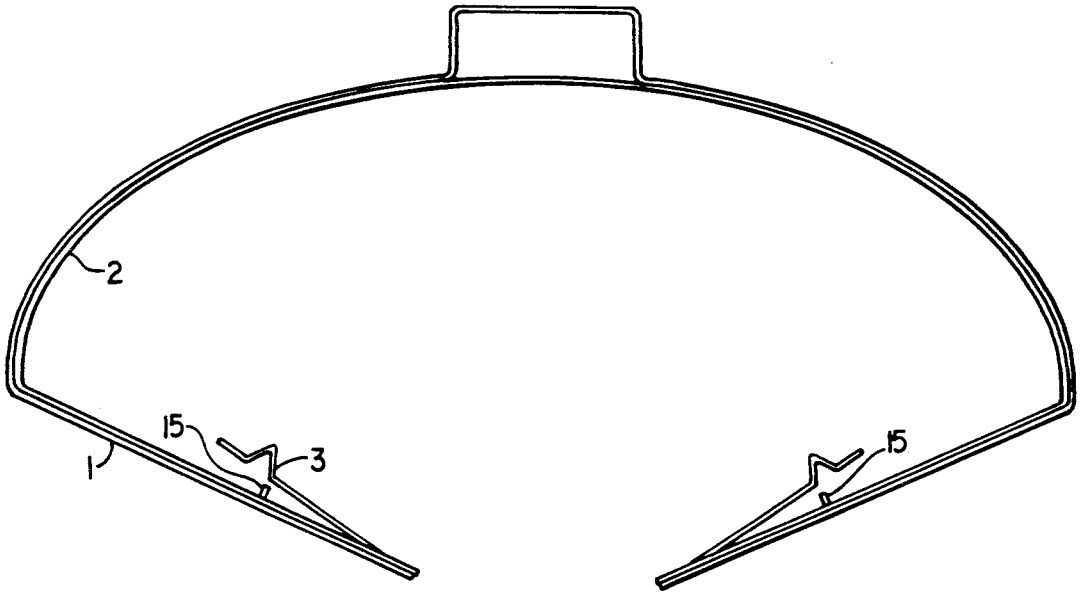
FIG. 1 is a side view of part of a headset embodying certain principles of this invention; including the rectangular bend on the first band.

With reference now to the drawings and more particularly FIG. 1, there is shown a side view of part of a headset embodying certain principles of the invention. A second resilient band 2 is shown nested inside a first band 1. The first resilient band 1 in this embodiment has a rectangular bend 4 on top. This bend may be omitted without departing from the invention. The rectangular bend 4 provides a location 8 to house various wires associated with the operation of the headset. The second band 2 has a narrow leaf spring 3 and upper limit tab 15 punched out near the end where both bands are grasped. The bands grasped at each end so that they are working in a bending moment. Leaf spring 3 rides in a pivot block 5 with toothed rack 10, (FIG. 2) to provide detent positions for the headband relative to the earcups. A feature of the invention resides in using thin resilient material for the leaf spring so that the detents, upper limit tab 15 and headband are formed from the same 15 stock. As can be seen from FIGS. 1 and 4 bands 1 and 2 are nested together to form a nested set of bands 1 and 2 of substantially constant nest length and substantially constant nest width substantially equal to the length and width respectively of bands 1 and 2.

Figure 2:
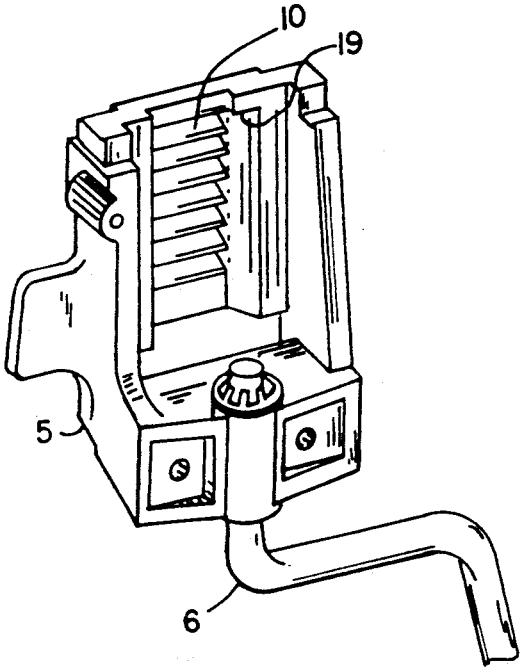
FIG. 2 is a view of the toothed rack.

FIG. 2 illustrates the pivot block 5 with toothed rack 10 that narrow leaf spring 3 rides on to provide detent positions for the headset relative to the earcups. Rod 6 bent as shown may be used to attach the earcup to pivot block 5. Upper limit stop 19 engages upper limit tab 15 to prevent the headbands from pulling free in the highest position.

Figure 3:
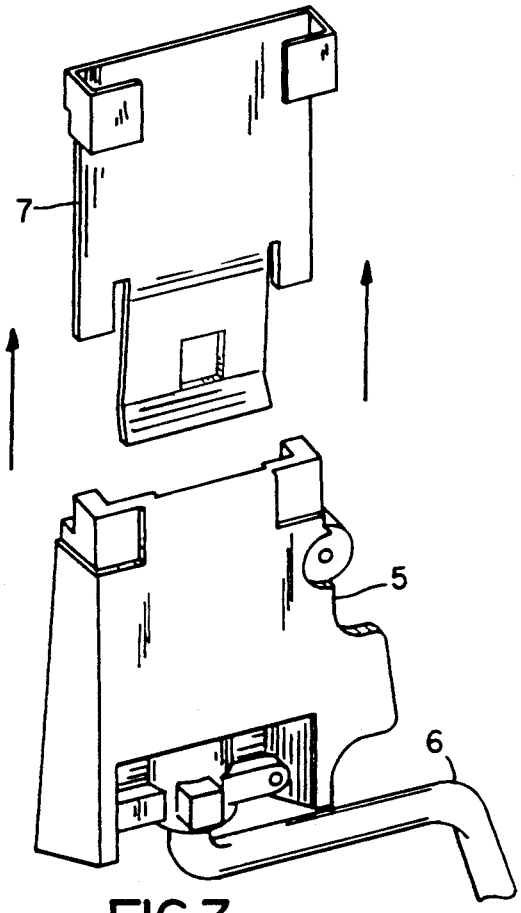
FIG. 3 is a view of the partially assembled block, showing the fastening clip.

FIG. 3 illustrates block 5 which comprises toothed rack 10, fastening clasp 7, and rod 6 for attaching the earcup to block 5. Block 5 helps hold the two bands together and forms the channel where the narrow leaf spring rides on the toothed rack.

FIG. 4 illustrates a perspective view of part of the headset shown in FIG. 1 embodying certain principles of this invention and better illustrates the narrow headband width 9 that can be achieved with this invention. Clips 1A and 2A embrace rectangular band 4 and help fasten bands 1 and 2 together.

Referring to FIG. 5, there is shown a pictorial view of a conventional yoke. To adjust the differing angles of the head between users, the earcup must have at least two degrees of rotational freedom relative to the headband. The first provides rotation about axis 11 which runs from the front to back of the user to allow for "pointed" to "tapered" heads. The second provides rotation about the vertical axis 12 to allow for heads which taper either to the rear or front of the user. (The only other possible axis of rotation which runs from ear to ear on the user is adjusted by rotating the entire headset.) In a conventional design a yoke band with a front and rear pivot is attached to the cups on axis 11. A pivot between the yoke and headband is on axis 12. While the design is simple, it has an appearance problem in that the yoke band is visible from the front of the headset. In addition, the two pivots on axis 11 must be accurately aligned for smooth rotation.

In this invention, the two axes are along a single stiff rod 6 which is bent to have its two ends 6A and 6B perpendicular to each other along respective ones of the two axes. Lower end 6A is generally normally horizontal and pivotally connected to earcup 22 allowing rotation about the horizontal axis. Upper end 6B is generally normally vertical and pivotally connected to pivot block 5 allowing rotation of an earcup 22 about the vertical axis. Ends 6A and 6B are interconnected by an upper rearwardly extending generally horizontal portion 6C, an outwardly and downwardly extending portion 6D, a short depending generally vertical portion 6E, and a short outwardly extending portion 6F perpendicular to end 6A. Advantages are fewer parts and a yoke which is essentially invisible from the front. This structure permits an entirely different styling approach for the headset and helps to differentiate between the front and back when the function requires it.

The invention preferably comprises two 12 inch long and 0.75 inch wide metal bands 1 and 2 nested together. Band 1 may have a one-inch long and 0.25 inch high rectangular bend in the middle. Band 2 has a 0.75 inch long leaf spring punched from each end. A 1.5 inch long and 0.8 inch wide block 5 is attached to each end of the band. Block 5 comprises a plastic toothed rack 10 and a metal fastening clasp which fit together. Block 5 grasps bands 1 and 2 at each end and provides detent positions for the headset relative to the earcups. An earcup is attached to each block.

While the invention has been particularly shown and described with reference to specific embodiments thereof, it will be understood by those skilled in the art that various changes in form and details may be made without departing from the spirit and scope of the invention as defined by appended claims. Other embodiments are within the claims.

What is claimed is:

1. A low spring rate headset having at least one ear cup comprising, (a) a first band of first width and first length;

(b) a second band of second width and second length approximately equal to said first width and first length respectively;

(c) said first and second bands nested together to form a nested set of said first and second bands of substantially constant nest length and substantially constant nest width substantially equal to said first length and said first width respectively;

(d) said bands being grasped at each end so that said bands are working in a bending moment;

(e) and a means to attach at least one ear cup to at least one end of said bands.

2. The headset of claim 1 wherein said nest width of said nested bands is less than the width of a headset single band of the same material providing the same amount of tension and spring rate.

3. The headset of claim 1 wherein there are means to attach wires to said bands.

4. The headset of claim 1 and further comprising, at least one toothed rack, means for adjusting the height of the headset comprising a narrow leaf spring punched from said first band where the leaf can ride on said toothed rack to provide detent positions for the headset relative to at least one earcup.

5. The headset of claim 4 and further comprising a limiter that limits said height.

6. The headset of claim 1 wherein said means to attach at least one ear cup to at least one of said bands comprises a rod formed with mutually perpendicular end sections allowing rotation of said at least one ear cup about mutually perpendicular axes.

7. The headset of claim 1 wherein said first band has a rectangular bend on top.

8. The headset of claim 7 wherein there are means to secure said bands together on either side of said rectangular bend.

9. The headset of claim 8 wherein said means to secure said bands together on either side of said rectangular bend comprise clips.

10. A headset comprising, a headband, at least one earcup, a stiff rod bent to be formed with mutually perpendicular first and second end sections having first and second mutually perpendicular axes respectively interconnected by intermediate portions and intercoupling said headband and said at least one earcup allowing rotation of said at least one earcup about said first and second mutually perpendicular axes.

11. A headset comprising a headband, at least one earcup, a rod formed with mutually perpendicular end sections intercoupling said headband and said at least one earcup allowing rotation of said at least one earcup about mutually perpendicular axes, wherein said end sections when respectively horizontal and vertical are interconnected by an upper rearwardly extending generally horizontal portion, an outwardly and downwardly extending portion, a short depending generally vertical portion and a short outwardly extending portion perpendicular to the then horizontal end section.

* * * * *